US008840207B2

(12) United States Patent
Wanibe

(10) Patent No.: US 8,840,207 B2
(45) Date of Patent: Sep. 23, 2014

(54) PRINTING APPARATUS AND METHOD FOR ADJUSTING A GAP

(71) Applicant: Seiko Epson Corporation, Tokyo (JP)

(72) Inventor: Akihisa Wanibe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/865,480

(22) Filed: Apr. 18, 2013

(65) Prior Publication Data

US 2013/0286066 A1 Oct. 31, 2013

(30) Foreign Application Priority Data

Apr. 26, 2012 (JP) ..... 2012-100984

(51) Int. Cl.
*B41J 25/308* (2006.01)
*B41J 2/015* (2006.01)
*B41J 2/145* (2006.01)

(52) U.S. Cl.
CPC ..... *B41J 2/145* (2013.01); *B41J 25/308* (2013.01)
USPC ..... 347/8; 347/20

(58) Field of Classification Search
CPC ..... B41J 11/20; B41J 25/308; B41J 25/312
USPC ..... 347/8, 20
See application file for complete search history.

(56) References Cited

U.S. PATENT DOCUMENTS

2001/0038401 A1* 11/2001 Kawase et al. ..... 347/42

FOREIGN PATENT DOCUMENTS

JP 2011-067964 A 4/2011

* cited by examiner

*Primary Examiner* — Jason Uhlenhake
(74) *Attorney, Agent, or Firm* — Global IP Counselors, LLP

(57) ABSTRACT

A printing apparatus includes: a support member that supports a recording medium; a head plate that extends in a direction that intersects a transporting direction of the recording medium; a head body mounted on the head plate and having a nozzle that ejects a liquid onto the recording medium supported on a surface of the support member; and adjusting members that respectively project from opposite ends of the head plate in a direction of the head plate that intersects the transporting direction toward the support member, and that position the head plate with respect to the surface of the support member when each distal end of the adjusting members contacts the surface of the support member.

11 Claims, 7 Drawing Sheets

PRINTING APPARATUS AND METHOD FOR ADJUSTING A GAP

CROSS-REFERENCE TO RELATED APPLICATIONS

The entire disclosure of Japanese Patent Application No. 2012-100984, filed Apr. 26, 2012 is expressly incorporated by reference herein.

BACKGROUND

1. Technical Field

The present invention relates to a printing apparatus which performs a printing operation by ejecting a liquid such as an ink or a recording liquid from a printing head onto a recording medium supported by a supporting member and a method for adjusting a gap.

2. Related Art

JP-A-2011-67964 (FIG. 1) discloses a printing apparatus in which a plurality of printing heads eject liquids such as different inks or recording liquids onto a recording medium such as a film so as to record a color image. In the printing apparatus, the recording medium is wrapped around a cylindrical platen drum in a state of tension being applied to the recording medium and is supported on a curved cylindrical surface. The plural printing heads are disposed around the platen drum so as to surround the platen drum.

In order to perform high quality printing, it is necessary to position the respective printing heads at predetermined orientations with respect to the platen drum. In particular, if any printing head comes to be in a slanted state, that is, a so-called "tilted state" with respect to the platen drum, a nozzle mounted on a distal end of the printing head in question comes to be in a non-parallel orientation relative to the surface of the platen drum, and a landing position of the liquid ejected from the nozzle onto the recording medium is deviated from a desired position. Accordingly, heretofore, the slanted state of the printing head was adjusted by mounting an adjusting mechanism on a carriage that holds and moves the printing head so as to adjust the slanted orientation, that is, a tilted angle, or by adjusting an angle of the carriage itself to make the nozzle parallel to the surface of the platen drum.

However, this adjusting mechanism is relatively large and requires a space in which to be installed. Consequently, the adjusting mechanism results in an increase in size of the carriage. Since the adjusting mechanism adopts a so-called trial and error method in which the mechanism performs operations to adjust and confirms the tilted state of the printing head repeatedly, there is a problem that much time and manpower are required for adjustment. In addition, since the printing apparatus disclosed in JP-A-2011-67964 is provided with a plurality of printing heads, it is necessary to perform adjustment of the tilted state for every color. This makes adjusting works complicated and results in an increase in the size of the apparatus.

SUMMARY

An advantage of some aspects of the invention is that there are provided a printing apparatus and a printing method in which a nozzle mounted on a printing head can be readily and precisely moved and positioned at a parallel orientation with respect to a surface of a support member and can perform high quality printing.

According to a first aspect of the invention, a printing apparatus includes: a support member that supports a recording medium; a head plate that extends in a direction that intersects a transporting direction of the recording medium; a head body mounted on the head plate and having a nozzle that ejects a liquid onto the recording medium supported on a surface of the support member; and adjusting members that respectively project from opposite ends of the head plate in a direction of the head plate that intersects the transporting direction toward the support member, and that position the head plate with respect to the surface of the support member by each distal end of the adjusting members contacting the surface of the support member.

It is preferable that the printing apparatus further include a head driving mechanism that can move the head plate positioned with respect to the surface of the support member in a gap-adjusting direction which is a direction in which a gap between the recording medium supported on the surface of the support member and the head plate is adjusted.

It is preferable that the head driving mechanism include: a holding unit provided so as to be movable in the gap-adjusting direction; a driving unit that moves the holding unit in the gap-adjusting direction; and a movable support member that can move with respect to the holding unit while supporting the head plate. The head plate is positioned with respect to the surface of the support member by the gap between the surface of the support member and the head plate being adjusted by the adjusting unit and by the movable support member being fixed to the holding unit, when the holding unit is disposed at a given position.

It is preferable that the movable support member be provided on the holding unit so as to be movable in the gap-adjusting direction.

It is preferable that the head driving mechanism include positioning pins that extend from the holding unit toward the opposite ends of the head plate in a direction of the head plate that intersects the transporting direction and that position the head plate in the transporting direction. The movable support member can rotate about the positioning pins.

It is preferable that the head driving mechanism include a fixing unit that fixes the movable support member to the holding unit. The movable support member supports the head plate in a state in which the distal ends of the adjusting members are in contact with the surface of the support member.

It is preferable that the adjusting members be provided on the head plate so as to be detachable therefrom.

A second aspect of the invention is directed to a method for adjusting a gap between a head plate and a support member in a printing apparatus. The printing apparatus uses a printing head having the head plate on which a head body is mounted and ejects a liquid onto a recording medium supported on the support member to perform printing. The method includes: mounting adjusting members on opposite ends of the head plate in a direction of the head plate that intersects a transporting direction of the recording medium so that the adjusting members project toward the support member; and moving the printing head toward the support member so that the direction of the head plate that intersects the transporting direction becomes parallel to the surface of the support member and each of distal ends of the adjusting members contact the surface of the support member. A printing apparatus according to the first aspect includes: a rotatable roller; a head plate that extends in an axial direction of a rotary shaft of the roller; a head body mounted on the head plate and having a nozzle that ejects a liquid onto a recording medium to be wrapped around a surface of the roller; and two adjusting members that respectively project from opposite ends of the head plate toward the roller, and that position the head plate with respect to the surface of the roller when each distal end of the adjusting members contacts the surface of the roller.

The second aspect of the invention is directed to a printing method that uses a printing head provided with a head plate on which a head body is mounted, and that performs printing by ejecting a liquid onto a recording medium to be wrapped around a rotatable roller. The printing method includes: providing adjusting members point toward the roller from the opposite ends of the head plate in the width direction of the head plate before the printing head performs printing; and positioning the printing head with respect to the roller so that the width direction of the head plate becomes parallel to an axial direction of a rotary shaft of the roller and each of distal ends of the adjusting members contacts a surface of the roller.

In the aspect of the invention constructed as described above, the adjusting members project from the opposite ends of the head plate in the width direction of the head plate toward the roller, respectively and the head plate is positioned with respect to the surface of the roller when the distal ends of the adjusting members contact the surface of the roller. It is possible in the aspect of the invention to position the nozzle so that the nozzle takes an orientation parallel to the surface of the roller (hereinafter referred to "a parallel orientation") and to precisely eject the liquid from the nozzle. This can print an excellent quality image.

When the distal ends of the adjusting members contact the surface of the roller, the head plate can be disposed at a reference position corresponding to the adjusting members from the surface of the roller and the above mentioned parallel orientation can also be obtained. Accordingly, a head driving mechanism may be provided that adjusts a gap between the recording medium wrapped around the roller and the nozzle by moving the head plate positioned by the adjusting members in the gap-adjusting direction. Thus, it is possible to precisely adjust the gap between the recording medium and the nozzle by moving the head plate while keeping the parallel orientation of the head plate after the head plate is disposed at the reference position.

The head driving mechanism may include a holding unit that is movable in the gap-adjusting direction, a driving unit that moves the holding unit in the gap-adjusting direction, and a movable support member that can move with respect to the holding unit while supporting the head plate. If the head plate is merely moved in the gap-adjusting direction, the holding unit may hold the head plate directly. However, there may be a case where it is difficult for the holding unit to always hold the head plate in the given positional relationship. Accordingly, it is desirable that a movable support member be provided on the holding unit so as to be movable and that the movable support member support the head plate. That is, since the head plate is held via the movable support member on the holding unit, it is possible to correct an orientation of the head plate with respect to the holding unit in the parallel orientation by making the movable support member displaceable.

Such movable support member may be, for example, a member that can move in the gap-adjusting direction with respect to the holding unit or positioning pins described below. The positioning pins are one of elements that constitute the head driving mechanism. Each of the positioning pins extends toward the corresponding end of the head plate in the width direction of the head plate and positions the head plate in the transporting direction of the recording medium. A member that can rotate about the positioning pins may be used as the movable support member.

Furthermore, the head driving mechanism may be constructed so as to include a fixing unit that fixes the movable support member that supports the head plate to the holding unit when the distal end of the adjusting member contacts the surface of the roller. Since such fixing unit always holds the head plate on the holding unit while keeping the head plate in the parallel orientation, the head plate is maintained in the parallel orientation when the head plate is moved by the head driving mechanism thereafter. As a result, it is possible to precisely adjust the gap between the recording medium and the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
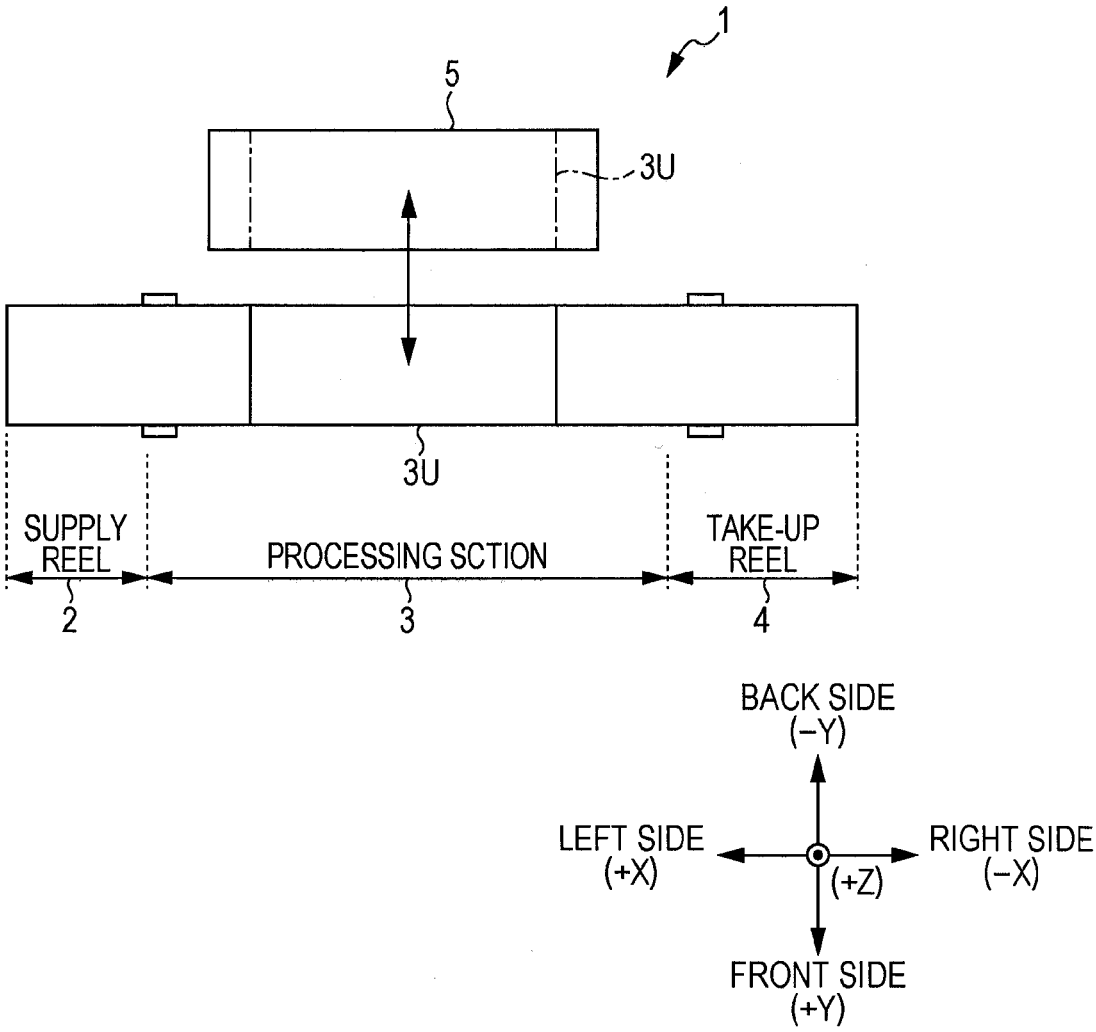
FIG. 1 is a layout of a first embodiment of a printing apparatus according to the invention.
Figure 2:
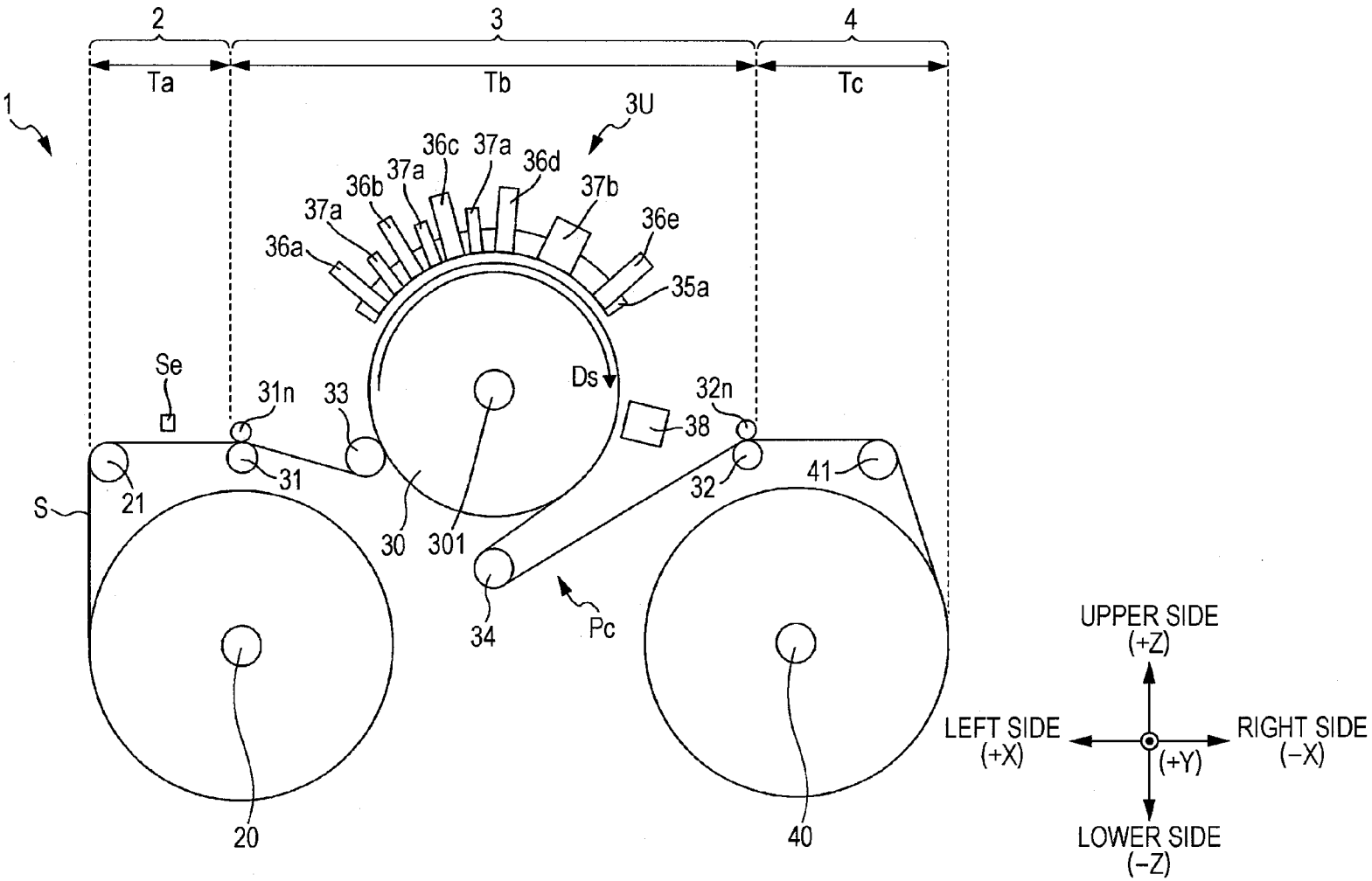
FIG. 2 is a front view schematically illustrating an example of the printing apparatus shown in FIG. 1.

FIG. 1 is a layout of a first embodiment of a printing apparatus according to the invention. FIG. 2 is a front view schematically illustrating an example of the printing apparatus shown in FIG. 1. In this printing apparatus 1, a supply reel 2, a processing section 3, and a take-up reel 4 are arranged in a left-right direction at a front side of the printing apparatus. A maintenance section 5 is located at a rear side of the processing section 3. A processing unit 3U of the processing section 3 is mounted on the maintenance section 5 so as to be movable. In FIG. 1 and FIG. 2 and the drawings mentioned after, a three-dimensional coordinate system that corresponds to a left-right direction X, a front-back direction Y, and a vertical direction Z in the recording apparatus 1.

As shown in FIG. 2, the supply reel 2 and the take-up reel 4 in the printing apparatus 1 have a supply reel shaft 20 and a take-up reel shaft 40, respectively. Opposite ends of a sheet (web) S are wrapped around the supply reel 2 and take-up reel 4 in a rolled state, respectively, so that the sheet S is stretched between the supply reel 2 and the take-up reel 4. The sheet S stretched along a path Pc between the reels 2 and 4 is transported from the supply reel shaft 20 to the processing section 3. After the sheet S is subject to a recording treatment by the processing unit 3U, the sheet S is transported to the take-up reel shaft 40. The sheet S that corresponds to "the recording medium" in the embodiments of the invention may be broadly classified as a paper based medium or a film based medium. In more detail, examples of a paper based medium include quality paper, cast paper, art paper, coated paper, and the like.

Examples of the film based medium include synthetic paper, PET (polyethylene terephthalate), PP (polypropylene), and the like. Hereinafter, a surface on which an image is recorded and is one of the two surfaces of the sheet S is referred to "a front surface" and a surface on which an image is not recorded and is the other surface of the sheet S is referred to "a back surface".

The supply reel 2 includes the supply reel shaft 20 around which an end of the sheet S is wrapped, and a driven roller 21 around which the sheet S drawn out from the supply reel shaft 20 is wrapped. The supply reel shaft 20 has the end of the sheet S wrapped therearound and supports the sheet S so that the front surface of the sheet S faces outward. When the supply reel shaft 20 rotates in a clockwise direction in the plane of FIG. 2, the sheet S wrapped around the supply reel shaft 20 is sent to the processing section 3 via the driven roller 21. The sheet S is wrapped around the supply reel shaft 20 via a core tube (not shown) that is supported on the supply reel shaft 20 so as to be detachable. Accordingly, when the sheet S on the supply reel shaft 20 is exhausted, a new core tube on which a rolled sheet S has been mounted is mounted on the supply reel shaft 20, so that the sheet S on the supply reel shaft 20 can be replaced. A symbol "Se" denotes an edge sensor that detects an edge in the width direction between the driven roller 21 and a front roller 31.

The processing section 3 prints an image on the sheet S by suitably performing a process by means of the processing unit 3U located on an outer peripheral surface of a platen drum 30 while the processing section 3 is supporting the sheet S supplied from the supply reel 2 by supporting the platen drum 30. In the processing section 3, a front driving roller 31 is located on a left side of the platen drum 30 and a rear driving roller 32 is located on a right side of the platen drum 30. The sheet S transported from the front driving roller 31 to the rear driving roller 32 is supported by the platen drum 30 and the image is recorded on the sheet S.

The front driving roller 31 is provided on its outer peripheral surface with a plurality of fine projections formed by spraying. The front driving roller 31 wraps the back surface of the sheet S supplied from the supply reel 2 around the outer peripheral surface of the roller 31. When the front driving roller 31 rotates in the clockwise direction in the plane of FIG. 2, the front driving roller 31 transports the sheet S supplied from the supply reel 2 downstream along the transporting path. A nip roller 31*n* is provided for the front driving roller 31. The nip roller 31*n* is biased toward the front driving roller 31 to contact the front surface of the sheet S. The sheet S is pinched between the front driving roller 31 and the nip roller 31*n*. Thus, it is possible to exert a frictional force between the front driving roller 31 and the sheet S, and it is possible for the front driving roller 31 to reliably transport the sheet S.

The platen drum 30 is a cylindrical drum that is supported by a supporting mechanism (not shown) so as to rotatable around a rotary shaft 301 that extends in the direction Y. The platen drum 30 wraps therearound the back surface of the sheet S transported from the front driving roller 31 to the rear driving roller 32. The platen drum 30 is rotated in the transporting direction Ds of the sheet S by the frictional force exerted between the platen drum 30 and the sheet S and supports the back surface of the sheet S. In the processing section 3, driven rollers 33 and 34 that turn the sheet S are provided on the opposite sides of the wrapping portion of the sheet S around the platen drum 30. The driven roller 33 wraps therearound the front surface of the sheet S between the front driving roller 31 and the platen drum 30 to turn the sheet S. On the other hand, the driven roller 34 wraps therearound the front surface of the sheet S between the rear driving roller 32 and the platen drum 30 to turn the sheet S. Thus, since the sheet S is turned upstream and downstream in the transporting direction Ds with respect to the platen drum 30, it is possible to increase the length of the portion of the sheet S wrapped around the platen drum 30.

A plurality of fine projections formed by spraying are provided on the outer peripheral surface of the rear driving roller 32. The rear driving roller 32 wraps the back surface of the sheet S supplied via the driven roller 34 from the platen drum 30 on the outer peripheral surface of the roller 32. When the rear driving roller 32 rotates in the clockwise direction in the paper surface of FIG. 2, the rear driving roller 32 transports the sheet S to the take-up reel 4. A nip roller 32*n* is provided for the rear driving roller 32. The nip roller 32*n* is biased toward the rear driving roller 32 so as to contact the front surface of the sheet S. The sheet S is pinched between the rear driving roller 32 and the nip roller 32*n*. Thus, it is possible to exert a frictional force between the rear driving roller 32 and the sheet S, and it is possible for the rear driving roller 32 to reliably transport the sheet S.

Thus, the sheet S transported from the front driving roller 31 to the rear driving roller 32 is supported on the outer peripheral surface of the platen drum 30. The processing section 3 is provided with the processing unit 3U in order to print a color image on the front surface of the sheet S that is supported on the platen drum 30. The processing unit 3U includes a pair of a front plate 35*a* and a rear plate 35*b* (see FIG. 3 and FIG. 4) that are arranged in the front-back direction in the processing unit 3U. The respective plates 35*a* and 35*b* are made into arcuate shapes that extend along the outer peripheral surface of the platen drum 30. The respective plates 35*a* and 35*b* are coupled to each other by a coupling member (not shown) to constitute a unit frame. As described later, constituent elements of the processing unit 3U are mounted on the unit frame. The constituent elements include printing heads 36*a* to 36*e*, UV (ultraviolet) lamps 37*a* and 37*b*, and a head driving mechanism 6.

Four printing heads 36*a*, 36*b*, 36*c*, and 36*d* are arranged in the transporting direction Ds in correspondence with the yellow, cyan, magenta, and black inks, in this order. In more detail, these four printing heads 36*a* to 36*d* are located in radiating manner from the rotary shaft 301 of the platen drum 30, respectively. Two printing heads 36*a* and 36*b* out of the four printing heads 36*a* to 36*d* are located upstream in the transporting direction Ds and are moved by a single head driving mechanism 6 so that the printing heads 36*a* and 36*b* are positioned with respect to the sheet S wrapped around the platen drum 30. Also, two printing heads 36*c* and 36*d* are located downstream in the transporting direction Ds and are moved by another head driving mechanism 6 so that the printing heads 36*c* and 36*d* are positioned with respect to the sheet S wrapped around the platen drum 30. These two head driving mechanisms 6 move and position the four printing heads 36*a* to 36*d* so as to properly set a distance, a so-called paper gap, between the sheet S and distal ends (ink ejection ports) of nozzles of the printing heads 36*a* to 36*d*. In a state where the paper gap is adjusted, the printing heads 36*a* to 36*d* eject the inks onto the sheet S wrapped around the outer peripheral surface of the platen drum 30 to form a color image on the front surface of the sheet S.

Figure 3:
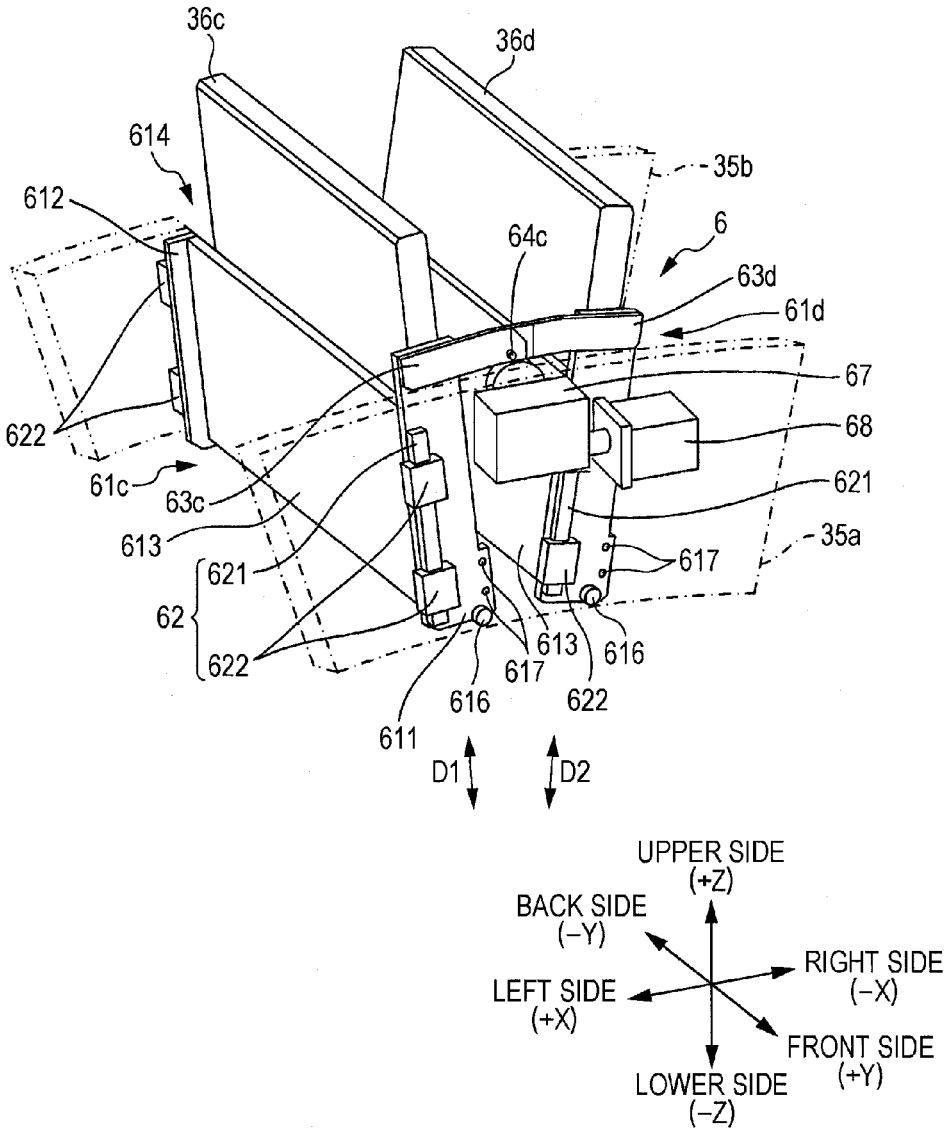
FIG. 3 is a perspective view of a head driving mechanism that moves and positions a printing head.
Figure 4:
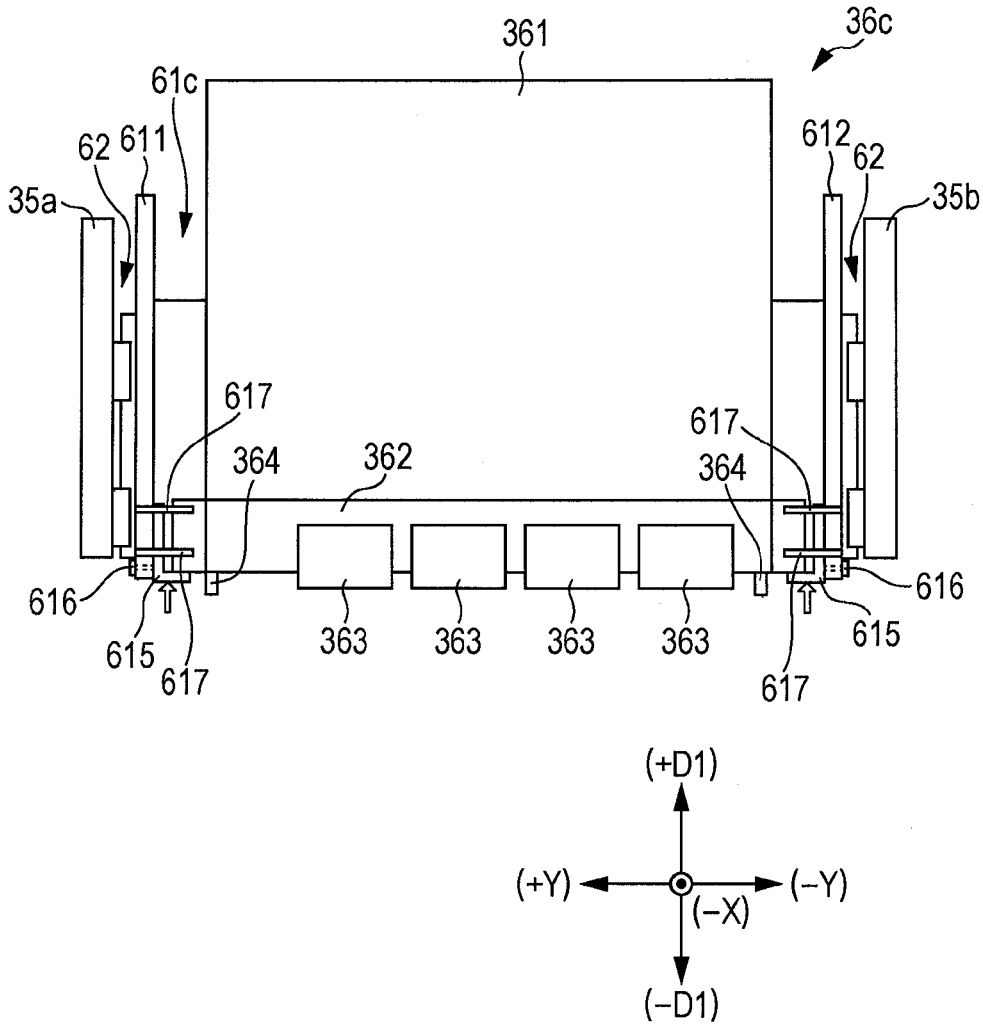
FIG. 4 is a side elevation view taken from a right side in FIG. 3, illustrating the printing head for a magenta ink.
Figure 5:
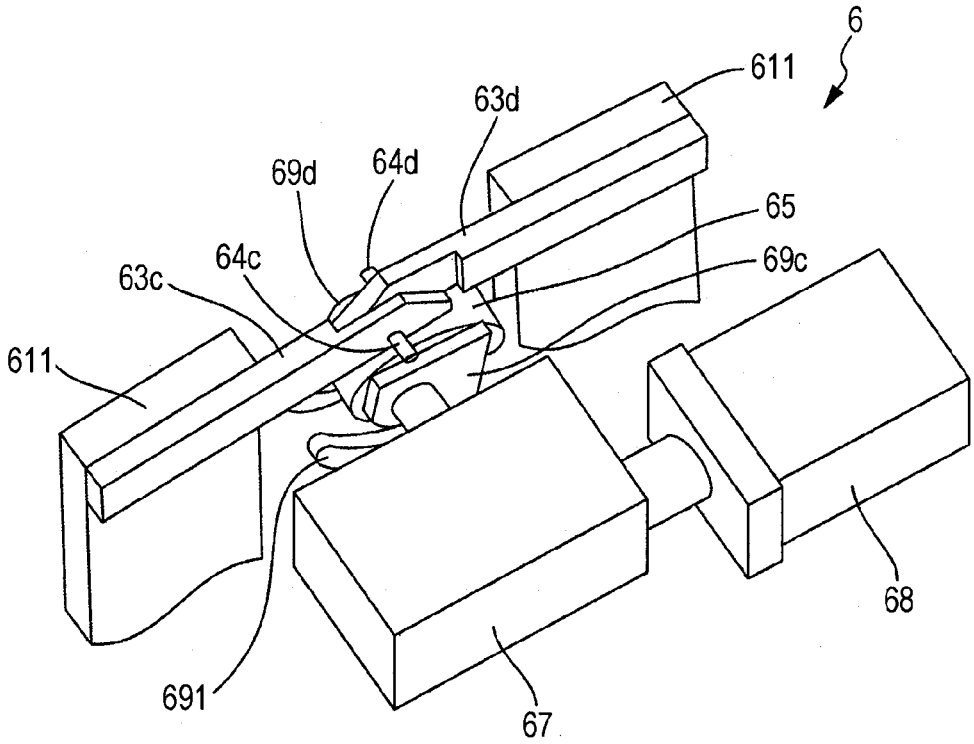
FIG. 5 is a perspective view of a part of the head driving mechanism shown in FIG. 3.

FIG. 3 is a perspective view of the head driving mechanism that moves and positions the two printing heads. FIG. 4 is a side elevation view taken from a right side in FIG. 3, illustrating the printing head 36*c* for the magenta ink. FIG. 5 is a perspective view of a part of the head driving mechanism 6 shown in FIG. 3. In FIG. 3, FIG. 4, and FIG. 5, only a structure of the printing head 36*c* and only a structure of the head driving mechanism 6 that drives the printing heads 36*c* and 36*d* are shown and other structures are omitted from the drawings. Although the structures of the printing head 36*c* and head driving mechanism 6 are described below by referring to FIG. 3 to FIG. 5, the structures of the other printing heads 36*a*, 36*b*, 36*d*, and 36*e* and the other head driving mechanism that drives the printing heads 36*a* and 36*b* are the same as the structures of the printing heads 36*c*, 36*d* and the driving mechanism. Accordingly, explanations of the structures of the other printing heads and head driving mechanism are omitted below.

In the first embodiment, a first direction D1 is defined as a direction perpendicular to a line tangential to the platen drum 30 at the position where the printing head 36*c* performs the printing operation (the position where the magenta ink hits the sheet S), that is, a radial direction along which the magenta ink passes to the hitting position from the rotary shaft 301 of the platen drum 30. The head driving mechanism 6 moves and positions the printing head 36*c* in the direction D1. Also, at the same time, a second direction D2 is defined as a direction perpendicular to a line tangential to the platen drum 30 at the position where the printing head 36*d* performs the printing operation (the position where the black ink hits on the sheet S), that is, a radial direction along which the black ink passes to the hitting position from the rotary shaft 301 of the platen drum 30. The head driving mechanism 6 moves and positions the printing head 36*d* in the direction D2. Thus, in the first embodiment, the moving directions D1 and D2 of the printed heads 36*c* and 36*d* are slanted by the given angles from each other and the head driving mechanism 6 moves and positions the printing heads 36*c* and 36*d* while maintaining the angular relationship between them. The head driving mechanism 6 is provided with a holder 61*c* that holds the printing head 36*c*. The holder 61*c* includes a front holder member 611, a rear holder member 612, and a coupling plate 613 that connects the holder members 611 and 612. The printing head 36*c* can be inserted from the direction (−Y) into the holder 61*c* via an opening 614 formed in the rear holder member 612.

The printing head 36*c* includes a substantially flat-plate-like casing 361 that contains an ink tank for storing the magenta ink, a driving substrate, and the like. As shown in FIG. 4, a head plate 362 is mounted on a distal end of the casing 361. The head plate 362 has an elongated rectangular shape that extends in a width direction (a left-right in FIG. 4). A plurality of head bodies 363 are mounted on the one main side of the head plate 362 after correctly positioning the head bodies 363. A plurality of head bodies 363 are mounted on the other main side of the head plate 362 after correctly positioning the head bodies 363, although the other main side of the head plate 362 is not shown in FIG. 4. In the first embodiment, the plural head bodies 363 mounted on the one and other main sides constitute the line heads. A height-adjusting pin 364 projects downward from each end of the head plate 362 in the width direction. The height-adjusting pins 364 extend from the head plate 362 by the same length. The two height-adjusting pins 364 are separated from each other in the width direction of the head plate 362 by an amount further than a printing area of the plural head bodies 363 so that the head bodies 363 are interposed therebetween. In the first embodiment, the height-adjusting pins 364 and 364 are mounted on the head plate 362 so as to be detachable therefrom. As described later, the height-adjusting pins 364 and 364 are mounted on the head plate 362 only in the case of adjusting the printing head 36*c* to be in parallel orientation and the pins are removed from the head plate 362 after finishing the adjustment.

The printing head 36*c* constructed as described above is inserted into the holder 61*c* while the width direction of the printing head 36*c* is aligned with the front-back direction Y of the holder 61*c*. The opposite ends of the head plate 362 of the printing head 36*c* are engaged with X-direction positioning pins 617 that project into the holder 61*c* from the front holder member 611 and the rear holder member 612. Thus, it is possible to restrain the printing head 36*c* from moving in the direction X in the holder 61*c* and to position the printing head 36*c* in the holder 61*c*.

As shown in FIG. 4, a movable support member 615 that has a substantially L-shape in a side elevation view and that can move in the first direction D1 with respect to the front holder member 611 is provided on the lower end of the front holder member 611. The head driving mechanism 6 is provided with spring members (not shown) so as to bias the movable support members 615 from a lower side to an upper side, that is, a departing direction (+D1) from the platen drum 30, as shown by hollow arrows in FIG. 4. Also, the rear holder member 612 is provided with a movable member 615, as is the case with the front holder member 611. Accordingly, when the printing head 36*c* is not inserted into the holder 61*c*, the movable support members 615, 615 are raised up to an upper limit position by biasing forces of the spring members.

Lower ends of the movable support members 615, 615 extend into an interior of the holder 61*c*, as shown in FIG. 4. When the printing head 36*c* is inserted into the holder 61*c*, both ends of the head plate 362 can be moved downward while the lower ends of the movable support members 615, 615 support the both ends of the head plate 362 until the height-adjusting pins 364, 364 contact the surface of the platen drum 30. Thus, when the height-adjusting pins 364, 364 contact the surface of the platen drum 30, the head plate 362 is disposed at a given height position from the surface of the platen drum 30 and parallel to the surface of the platen drum 30. Consequently, the printing head 36*c* keeps the parallel orientation. In order to keep the printing head 36*c* in the parallel orientation, fixing screws 616 and 616 are provided on lower ends of the front holder member 611 and the rear holder member 612. The fixing screws 616, 616 secure the movable support members 615, 615 to the holder 61*c*. The structure in which the fixing screws 616, 616 are provided on the holder members 611, 612 in the holder 61*c* is also similarly provided on the holder 61*d*. Movable support members provided on the holder 61*d* can support the printing head 36*d*.

In order to move the printing heads 36*c* and 36*d* in the first direction D1 and the second direction D2, respectively, while the movable support members 615, 615 support the printing heads 36*c* and 36*d*, the head driving mechanism 6 further includes a structure described below.

A linear guide 62 extends from each of a front side of the front holder member 611 and a rear side of the rear holder member 612. The two linear guides 62, 62 guide the holder 61*c* slidably in the first direction D1 with respect to the front plate 35*a* and the rear plate 35*b*. In more detail, as shown in FIG. 3, a linear rail 621 that extends in the first direction D1 is secured to the front side of the front holder member 611, and two sliders 622, 622 are mounted on the rail 621 so as to be slidable in the first direction D1. Two sliders 622, 622 are fixed on the rear side of the front plate 35*a*. Another linear guide 62 is mounted on the rear side of the rear holder member 612, as is the case with the structure of the front holder member 611. The sliders 622, 622 of the linear guide 62 are fixed on the front side of the rear plate 35*b*. Thus, since two linear guides 62, 62 are respectively provided on the front and rear sides of the holders 61*c*, the holder 61*c* can be moved in the first direction D1 while the holders 61*c* hold the printing head 36*c*.

The head driving mechanism 6 is provided with a holder 61*d* that holds the printing head 36*d* and is separated by a given distance downstream from the holder 61*c* in the transporting direction Ds. The holder 61*d* includes a front holder member 611, a rear holder member 612, and a coupling plate 613, as is the case with the holder 61*c*. The printing head 36*d* can be inserted into the holder 61*d* via an opening 614 formed in the rear holder member 612.

A linear guide 62 extends from each of a front side of the front holder member 611 and a rear side of the rear holder member 612. The two linear guides 62, 62 guide the holder 61*d* slidably in the second direction D2 with respect to the front plate 35*a* and the rear plate 35*b*. The structures of the linear guides 62, 62 provided in the holder 61*d* are the same as those of the linear guides 62, 62 provided in the holder 61*c* except that the extending direction of the rail 621 of the holder 61*d* is different from that of the rail 621 of the holder 61*c*. Accordingly, detailed explanation of the liner guides 62, 62 is omitted here and the same symbols denote the linear guides 62, 62.

The one end (a left side end) of a left side cam follower 63*c* is secured to the front holder member 611 that constitutes part of the holder 61*c*. The other end (a right side end) of the left side cam follower 63*c* extends toward the holder 61*d* in the right side direction, that is, in the direction (−X) to an intermediate position between the two front holder members 611, 611. As shown in FIG. 5, a back side of the other end of the left side cam follower 63*c* is cut away by half (½) the thickness to make a small thickness portion. An engaging pin 64*c* projects from the other end of the left side cam follower 63*c* in the front side direction, that is, the direction (+Y).

The one end (a right side end) of a right side cam follower 63*d* is secured to the front holder member 611 that constitutes part of the holder 61*d*. The other end (a left side end) of the right side cam follower 63*d* extends toward the holder 61*c* in the left side direction, that is, the direction (+X) to an intermediate position between the two front holder members 611, 611. As shown in FIG. 5, a front side of the other end of the right side cam follower 63*d* is cut away by half (½) the thickness to make a small thickness portion. An engaging pin 64*d* projects from the other end of the right side cam follower 63*d* in the front side direction, that is, the direction (−Y). The lower sides of the other ends of the left and right side cam followers 63*c* and 63*d* are adjacent to each other and the thickness portions of the com followers 63*c* and 63*d* are brought into close contact with each other so as to slidably move.

A cam 65 is rotatably arranged so as to be capable of rotating at an intermediate position between the holders 61*c* and 61*d* and the cam 65 is always disposed below the other ends of the cam followers 63*c* and 63*d*. The outer peripheral surface of the cam 65 contacts the lower sides of the other ends of the cam followers 63*c* and 63*d* so as to support the other ends of the cam followers 63*c* and 63*d*. The cam 65 has a thickness slightly larger than thicknesses of the cam followers 63*c* and 63*d*. The cam 65 is mounted on a cam shaft 66 that extends in the front-back direction Y. The cam shaft 66 is coupled via a power transmission unit 67 to a rotary actuator 68 such as a motor. A rotary driving force generated by the rotary actuator 68 is transmitted via the power transmission unit 67 to the cam shaft 66. Thus, the cam shaft 66 is rotated about its axis and the cam 65 is also rotated. The cam followers 63*c* and 63*d* are raised simultaneously by the same distance in the vertical direction Z with rotation of the cam 65 while the lower sides of the other ends of the cam followers 63*c* and 63*d* slide along the outer peripheral surface of the cam 65. Consequently, the holder 61*c* coupled to the cam follower 63*c* is raised in the first direction D1 so as to position the printing head 36*c* in the first direction D1, thereby adjusting a gap between the distal end of a nozzle of the printing head 36*c* and the sheet S to be a desired paper gap. At the same time when positioning the printing head 36*c*, the printing head 36*d* is positioned and a gap between the distal end of a nozzle of the printing head 36*d* and the sheet S is adjusted to be a desired paper gap.

Next, in the printing apparatus 1 constructed as described above, an operation for positioning the printing head 36*c* in the parallel orientation and for adjusting the paper gap will be described below by referring to FIG. 6A and FIG. 6B.

Figure 6A:
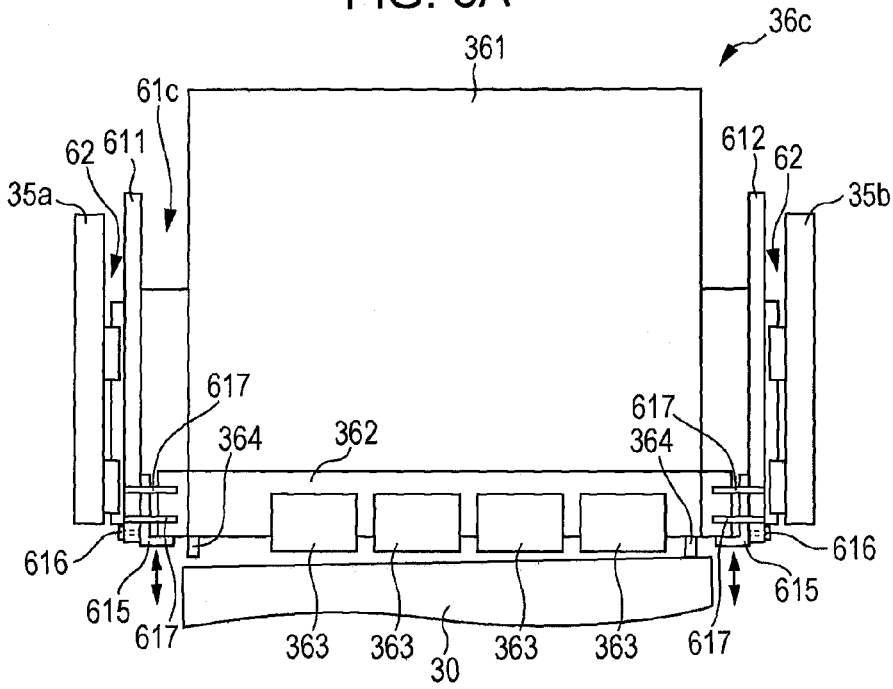
FIG. 6A is a side elevation view of the head driving mechanism, schematically illustrating an operation of adjusting the head driving mechanism at a starting time of adjustment of the head driving mechanism.
Figure 6B:
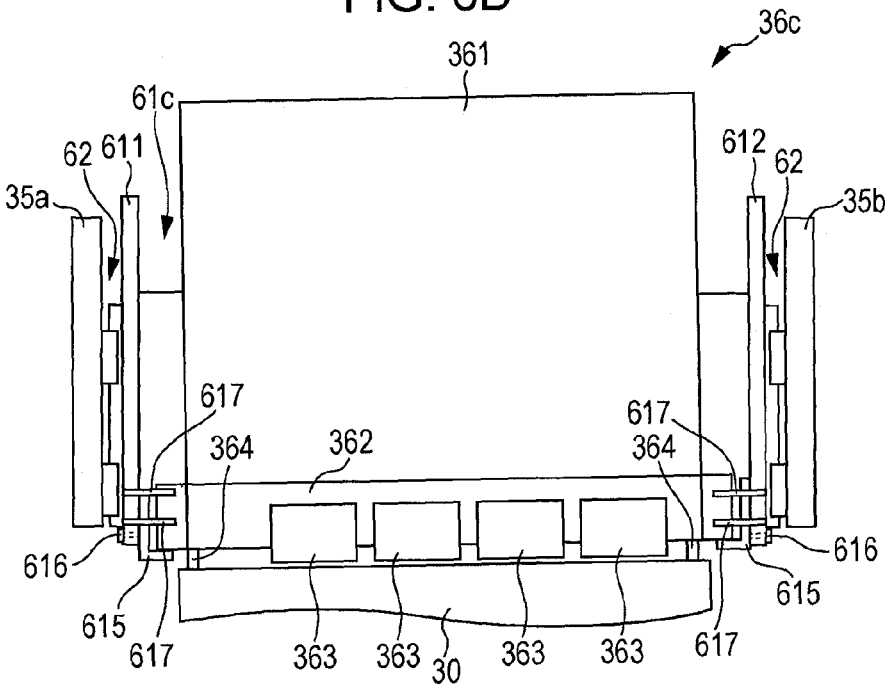
FIG. 6B is a side elevation view of the head driving mechanism, schematically illustrating an operation of adjusting the head driving mechanism at a finishing time of adjustment of the head driving mechanism.

FIG. 6A and FIG. 6B schematically show adjusting operations of the printing head 36*c* prior to performance of printing by the printing apparatus 1. FIG. 6A shows a positional relationship between the printing head and the platen drum at a starting time of adjustment, while FIG. 6B shows a positional relationship between the printing head and the platen drum at a finishing time of adjustment. The respective printing heads 36*a* to 36*e* must be positioned so that the head bodies 363 are parallel to the surface of the platen drum 30, that is, the head bodies 363 keep the parallel orientation. However, for example, as shown in FIG. 6A, there is a case where the head driving mechanism 6 is slanted with respect to the platen drum 30. In this case, the printing heads 36*c* and 36*d* are in a slanted state or a so-called "tilted state" with respect to the surface of the platen drum 30. Accordingly, as shown in FIG. 6A and FIG. 6B, the height-adjusting pins 364, 364 are mounted on the head plates 362 of the printing heads 36*a* to 36*e* in the first embodiment so that the printing heads 36*c* and 36*d* are corrected to be in the parallel orientation. After finishing the correction of the printing heads, the height-adjusting pins 364, 364 are removed from the head plates 362 of the printing heads 36*a* to 36*e*, and then the printing heads 36*c* and 36*d* are moved in the first direction D1 and the second direction D2 by the head driving mechanism 6, respectively to adjust the paper gap. The above correcting and adjusting operations will be described below by way of the tilted state of the printing head 36*c*.

In the case of the tilted state of the printing head 36*c*, the fixing screws 616, 616 mounted on the holder 61*c* that holds the printing head 36*c* are loosened so that the movable support members 615, 615 can move in the first direction D1. Then, when an operator pushes down the printing head 36*c*, as shown in FIG. 6A, the one height-adjusting pin 364 contacts the surface of the platen drum 30. At this time, the other height-adjusting pin 364 is separated from the surface of the platen drum 30.

Then, when the operator further pushes down the printing head 36*c* continuously, the other height-adjusting pin 364 moves toward the surface of the platen drum 30 while the one height-adjusting pin 364 is in contact with the surface of the platen drum 30. As shown in FIG. 6B, the other height-adjusting pin 364 soon contacts the surface of the platen drum 30. Thus, the printing head 36*c* is corrected so that the head plate 362 is in parallel orientation, that is, an orientation in which the head plate 362 is parallel to the surface of the platen drum 30. In this state, when the operator fastens the fixing screws 616, 616, the movable support members 615, 615 are secured to the front holder member 611 and the rear holder member 612, respectively. Accordingly, thereafter, the rotary actuator 68 is actuated in response to a command from a control unit (not shown) that controls the whole of the printing apparatus and the cam 65 is rotated. Then, the printing head 36*c* is moved in the first direction D1 as the printing head 36*c* maintains the parallel orientation. Consequently, as shown in FIG. 6B, the position where the printing head 36*c* takes the parallel orientation is set as a reference position. When the raising amount of the printing head 36*c* is controlled on the basis of the reference position, it is possible to precisely adjust the paper gap between the distal ends of the nozzles of the head bodies 363 mounted on the head plate 362 and the sheet S wrapped around the platen drum 30 while maintaining the head plate 362 parallel to the sheet S wrapped around the platen drum 30.

As described above, in the first embodiment, since the two height-adjusting pins 364, 364, which project from the lower side of the head plate 362 by the same length, are brought into contact with the surface of the platen drum 30, the orientation of the printing head 36*c* is corrected so that the head plate 362 becomes parallel to the surface of the platen drum 30. Thus, the head bodies 363 are mounted on the head plate 362 with correct positioning by a simple structure, and the head bodies 363 can be positioned with respect to the surface of the platen drum 30. It is possible to eject the magenta ink from the head bodies 363 while keeping the parallel orientation and it is possible to print an image with excellent quality.

After the printing head 36*c* is disposed at the reference position, described above, the printing head 36*c* is moved in the first direction D1 and the paper gap between the sheet S and the distal ends of the nozzles of the head bodies 363 is adjusted. Accordingly, it is possible to precisely adjust the paper gap between the sheet S and the distal ends of the nozzles of the all head bodies 363 mounted on the printing head 36*c*.

Furthermore, in the first embodiment, since the printing head 36*c* is held via the movable support members 615, 615 on the holder 61*c*, it is possible to smoothly perform an adjusting operation to the parallel orientation.

Such a correcting operation can be similarly applied to the other printing heads 36*a*, 36*b*, 36*d*, and 36*e*. Accordingly, it is possible in the printing apparatus 1 according to the first embodiment to precisely position any one of the printing heads 36*a* to 36*e* with respect to the surface of the platen drum 30 and to accomplish printing with high quality.

Thus, the platen drum 30 in the first embodiment corresponds to "a support member" in the aspect of the invention. Also, the height-adjusting pin 364 corresponds to "an adjusting member" in the aspect of the invention. The holders 61*c* and 61*d* correspond to "a holding unit" in the aspect of the invention. The cam 65 and the cam followers 63*c* and 63*d* serve as "a driving unit" in the aspect of the invention, and the first direction D1 and the second direction D2 correspond to "a gap-adjusting direction" in the aspect of the invention. The fixing screw 616 corresponds to "a fixing unit" in the aspect of the invention.

It should be noted that the aspect of the invention is not limited to the first embodiment. It is possible to alter the first embodiment without departing from the sprit of the invention. For example, although the movable support member 615 is provided so as to be capable of sliding in the first direction D1 with respect to holder 61*c* in the first embodiment, the movable support member 615 is not limited to the above structure. The movable support member 615 may move slidably in the first direction D1 with respect to the holder 61*c* while supporting the printing head 36*c*. For example, the movable support member 615 may be constructed as shown in FIG. 7.

Figure 7:
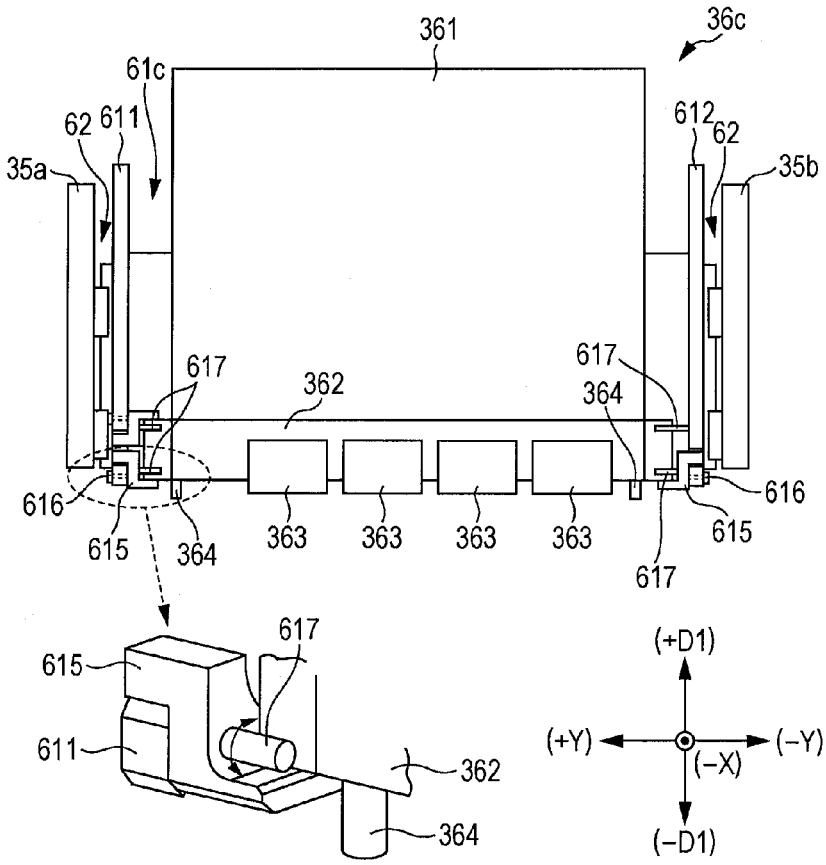
FIG. 7 is a side elevation view illustrating a second embodiment of the printing apparatus according to the invention.

FIG. 7 shows a second embodiment of the printing apparatus according to the invention. A main difference of the second embodiment from the first embodiment is a shape of the movable support member 615 and a specific structure for moving the member 615, and the other structures of the second embodiment is the same as that of the first embodiment. Accordingly, the movable support member 615 will be described below with a particular emphasis on the differences and the description of the same structures is omitted and the same symbols are used to denote them.

In the second embodiment, the movable support member 615 is provided so as to be capable of rotating about an X-direction positioning pin 617. The movable support member 615 disposed on the side of the front holder member 611 is biased to rotate about a rotary center of the X-direction positioning pin 617 in the counterclockwise direction by a front side spring member (not shown), as shown in FIG. 7. The rear movable support member 615 disposed on the side of the rear holder member 612 is biased to rotate about a rotary center of the X-direction positioning pin 617 in the opposite direction from the front movable support member 615. That is, the movable support members 615, 615 are biased to the direction for separating the printing head 36*c* from the surface of the platen drum 30. Functions and operations of the movable support members 615, 615 are the same as those in the first embodiment.

In the printing apparatus 1 using the movable support members 615, 615 constructed as described above, it is also possible to position the head plate 362 parallel to the surface of the platen drum 30 by bring the two height-adjusting pins 364, 364, which project from the lower side of the head plate 362 by the same length, into contact with the surface of the platen drum 30, as is the case with the first embodiment. As a result, it is possible to obtain the same operational effect as the first embodiment. In addition, since the movable support member 615 is provided so as to be rotatable about the X-direction positioning pin 617 in the second embodiment, it is possible to further simplify the structure in comparison with the first embodiment.

Although a single head driving mechanism 6 drives the two printing heads simultaneously in the above embodiments, a printing apparatus in which a single head driving mechanism can drive the respective printing heads 36*a* to 36*e* can be applied to the aspect of the invention.

Although the rotary driving force generated from the rotary actuator 68 is transmitted via the power transmission member 67 to the cam shaft 66 in the above embodiments, the rotary driving force may be transmitted from the rotary actuator 68 to the cam shaft 66.

Although the printing apparatus 1 provided with the plural printing heads that eject the UV (ultraviolet) ink is applied to the invention in the above embodiments, it should be noted that the concrete structure and the number of the printing heads are not limited to the above embodiments.

What is claimed is:

1. A printing apparatus comprising:

a support member that supports a recording medium such that the recording medium is transported in a transporting direction while contacting a surface of the support member;

a head plate that extends in a direction that intersects the transporting direction of the recording medium;

a head body mounted on the head plate and having a nozzle that ejects a liquid onto the recording medium supported on the surface of the support member; and adjusting members that respectively project from opposite ends of the head plate toward the support member with the adjusting members being spaced apart from each other in the direction of the head plate that intersects the transporting direction of the recording medium, and that position the head plate with respect to the surface of the support member by each distal end of the adjusting members contacting the surface of the support member.

2. The printing apparatus according to claim 1, further comprising:

a head driving mechanism that can move the head plate positioned with respect to the surface of the support member in a gap-adjusting direction which is a direction in which a gap between the recording medium supported on the surface of the support member and the head plate is adjusted.

3. The printing apparatus according to claim 2, wherein the head driving mechanism includes:

a holding unit provided so as to be movable in the gap-adjusting direction;

a driving unit that moves the holding unit in the gap-adjusting direction; and a movable support member that can move with respect to the holding unit while supporting the head plate; and wherein the head plate is positioned with respect to the surface of the support member by the gap between the surface of the support member and the head plate being adjusted by the adjusting unit and by the movable support member being fixed to the holding unit, when the holding unit is disposed at a given position.

4. The printing apparatus according to claim 3, wherein the movable support member is provided on the holding unit so as to be movable in the gap-adjusting direction.

5. The printing apparatus according to claim 3, wherein the head driving mechanism includes positioning pins that extend from the holding unit toward the opposite ends of the head plate in a direction of the head plate that intersects the transporting direction and that position the head plate in the transporting direction; and wherein the movable support member can rotate about the positioning pins.

6. The printing apparatus according to claim 3, wherein head driving mechanism includes a fixing unit that fixes the movable support member to the holding unit, the movable support member being adapted to support the head plate in a state in which the distal ends of the adjusting members are in contact with the surface of the support member.

7. The printing apparatus according to claim 1, further comprising:

an additional head plate; and additional adjusting members that respectively project from opposite ends of the additional head plate, the adjusting members and the additional adjustment members independently positioning the head plate and the additional head plate, respectively, with respect to the surface of the support member.

8. A printing apparatus comprising:

a support member that supports a recording medium;

a head plate that extends in a direction that intersects a transporting direction of the recording medium;

a head body mounted on the head plate and having a nozzle that ejects a liquid onto the recording medium supported on a surface of the support member; and adjusting members that respectively project from opposite ends of the head plate in a direction of the head plate that intersects the transporting direction toward the support member, and that position the head plate with respect to the surface of the support member by each distal end of the adjusting members contacting the surface of the support member, wherein the adjusting members are provided on the head plate so as to be detachable therefrom.

9. A method for adjusting a gap between a head plate and a support member in a printing apparatus that uses a printing head having the head plate on which a head body is mounted and that ejects a liquid onto a recording medium supported on a surface of the support member to perform printing, with the recording medium being transported in a transporting direction while contacting the surface of the support member;

the method comprising:

mounting adjusting members on opposite ends of the head plate so that the adjusting members project toward the support member, and so that the adjusting members are spaced apart from each other in a direction of the head plate that intersects the transporting direction of the recording medium; and moving the printing head toward the support member so that the direction of the head plate that intersects the transporting direction becomes parallel to the surface of the support member and each of distal ends of the adjusting members come into contact with the surface of the support member.

10. The method according to claim 9, wherein the adjusting members are provided on the head plate so as to be detachable therefrom.

11. The method according to claim 9, further comprising removing the adjusting members from the head plate after the moving of the printing head toward support member.

* * * * *